US008376518B2

(12) United States Patent
Imamura et al.

(10) Patent No.: US 8,376,518 B2
(45) Date of Patent: Feb. 19, 2013

(54) LIQUID DISCHARGE HEAD AND METHOD FOR MANUFACTURING THE SAME

(75) Inventors: Isao Imamura, Kawasaki (JP); Tadayoshi Inamoto, Hachioji (JP); Akane Hisanaga, Kawasaki (JP); Hiroki Kihara, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 12/813,697

(22) Filed: Jun. 11, 2010

(65) Prior Publication Data

US 2010/0315462 A1 Dec. 16, 2010

(30) Foreign Application Priority Data

Jun. 16, 2009 (JP) ..... 2009-143525
Oct. 2, 2009 (JP) ..... 2009-230649

(51) Int. Cl.
*B41J 2/135* (2006.01)
*B41J 2/015* (2006.01)

(52) U.S. Cl. ..... 347/45; 347/20

(58) Field of Classification Search ..... None
See application file for complete search history.

(56) References Cited

U.S. PATENT DOCUMENTS

2005/0078143 A1* 4/2005 Shimomura et al. ..... 347/20
2007/0236542 A1 10/2007 Graham

FOREIGN PATENT DOCUMENTS

JP 2007-331235 * 12/2007
JP 2007-331235 A 12/2007

* cited by examiner

*Primary Examiner* — Geoffrey Mruk
(74) *Attorney, Agent, or Firm* — Canon U.S.A., Inc., IP Division

(57) ABSTRACT

A liquid discharge head includes a substrate having, on one side thereof, energy generating elements for generating energy used for discharging liquid, and a sealing member arranged in contact with at least a part of one or more end faces of the substrate, the sealing member being a cured product of a composition having an epoxy resin having a butadiene skeleton and an epoxy resin curing agent having a butadiene skeleton.

6 Claims, 4 Drawing Sheets

LIQUID DISCHARGE HEAD AND METHOD FOR MANUFACTURING THE SAME

BACKGROUND OF THE INVENTION

1. Field of the Invention

The present invention relates to a method for manufacturing a liquid discharge head for discharging liquid, and specifically to a method for manufacturing an ink jet recording head for recording by discharging ink onto a recording medium.

2. Description of the Related Art

Examples of liquid discharge heads, which discharge liquid, include ink jet recording heads used for ink jet recording by discharging ink onto a recording medium.

U.S. Patent Application Publication No. 2005/0078143 discusses an ink jet recording head as follows. A discharge element substrate including energy generating elements for generating energy used for liquid discharge and a member having liquid discharge ports and liquid flow paths is electrically connected to a flexible wiring board. The sides of the discharge element substrate are coated with a sealant to form a side sealing member for protecting the sides from ink and dust. The main agent of the side sealing member includes an epoxy resin having a polybutadiene skeleton. A material to be a sealing member (electrical contact sealing material) for sealing lead bonding sites, which are electrical contacts, is applied and cured, thereby forming a sealing member.

The main agent of the side sealing member is composed of an epoxy resin having a butadiene skeleton with low reactivity from the viewpoint of elastic modulus. However, there has been an issue that the resin gives a low degree of cure and has low liquid resistance due to its properties. In addition, the curing may take a long time.

SUMMARY OF THE INVENTION

According to an aspect of the present invention, a liquid discharge head includes a substrate having, on one side thereof, energy generating elements for generating energy used for discharging liquid, and a sealing member arranged in contact with at least a part of one or more end faces of the substrate, the sealing member being a cured product of a composition having an epoxy resin having a butadiene skeleton and an epoxy resin curing agent having a butadiene skeleton.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
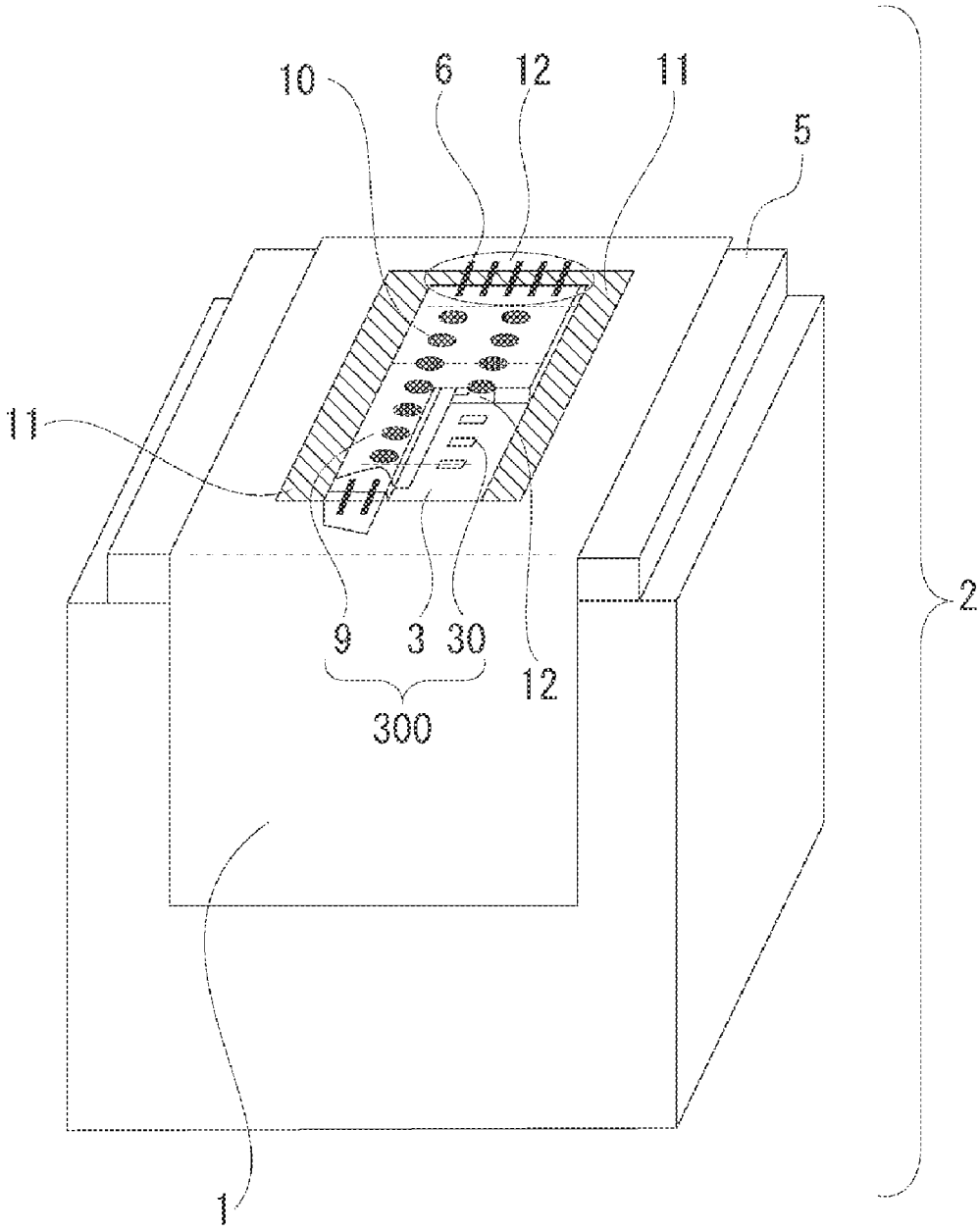
FIG. 1 is a perspective view illustrating a liquid discharge head according to an exemplary embodiment of the present invention.

FIG. 1 is a perspective view illustrating a liquid discharge head according to an exemplary embodiment of the present invention. A liquid discharge head 2 includes a discharge element substrate 300 and a sealing member 11 arranged around a substrate 3, which is a part of the discharge element substrate 300. The discharge element substrate 300 includes the substrate 3 having a plurality of energy generating elements 30 for generating energy used for liquid discharge, and a discharge port member 9 having discharge ports 10 provided corresponding to the elements. The discharge ports 10 communicating with flow paths 13 are provided. The discharge element substrate 300 is supported and fixed by a supporting member 5. The sealing member 11 is provided around the substrate 3 in contact with at least a part of one or more end faces as sides of the substrate 3, thereby preventing the end faces as sides of the substrate 3 from being exposed to liquids. The sealing member 11 is in contact with the supporting member 5. The discharge element substrate 300 is connected to an electric wiring member 1 through leads 6, and the leads 6 are sealed with a lead sealing member 12.

Figure 2:
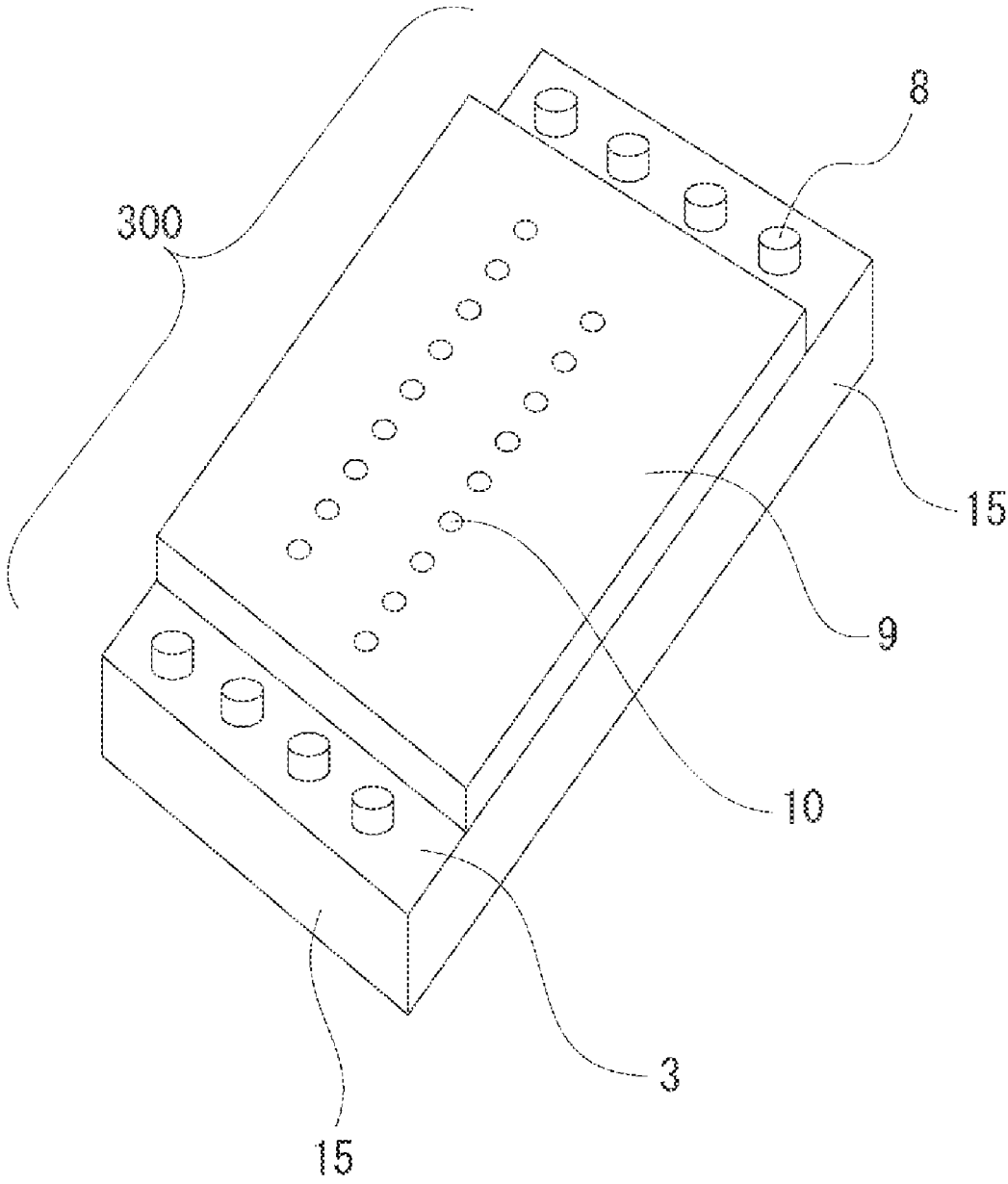
FIG. 2 is a perspective view illustrating a liquid discharge head substrate according to an exemplary embodiment of the present invention.

FIG. 2 is a perspective view illustrating the discharge element substrate 300. In the discharge element substrate 300, pads 8 are provided at the edges of a surface of the substrate 3 having the discharge port member 9, and external power is supplied through the pads 8. The sealing member 11 is in contact with end faces 15 as sides of the substrate 3. The substrate 3 is normally a rectangular parallelepiped. The substrate 3 may also be a circle or ellipse as seen from the surface with no corners about its circumference. The sealing member 11 may be arranged all around the substrate 3.

Figure 3A:
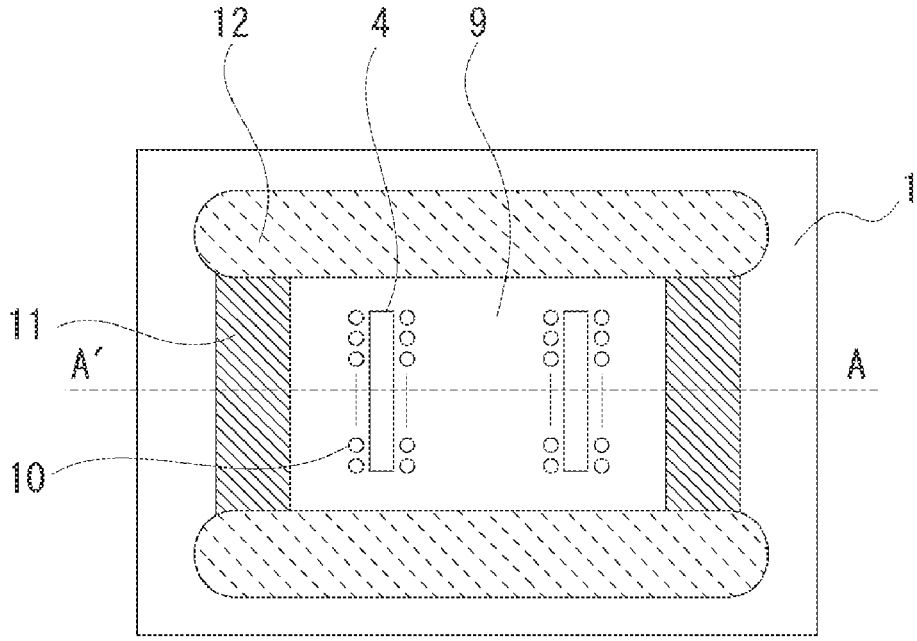
FIGS. 3A and 3B are top and cross sectional views illustrating a manufacturing process of the liquid discharge head according to an exemplary embodiment of the present invention.

FIG. 3A is a perspective view illustrating a part of the liquid discharge head according to an exemplary embodiment of the present invention, seen from the top surface. The discharge ports 10 are arranged in lines on both sides of a supply port 4 provided on the substrate. A plurality of supply ports 4 may be provided on one substrate.

Figure 3B:
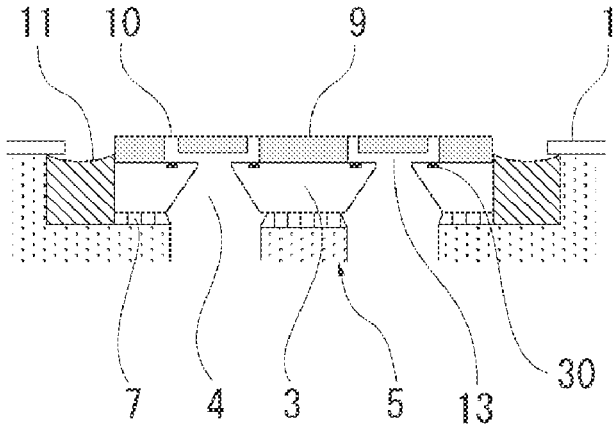

FIG. 3B is an A-A' cross sectional view of FIG. 3A. The substrate 3 is bonded to the supporting member 5 through an adhesive 7. The supply ports 4 feed a liquid such as ink to be discharged through the flow paths 13 to the energy generating elements 30 such as heaters or piezoelectric elements.

The sealing member 11 is in contact with the end faces of the substrate 3 and the supporting member 5. The discharge port member 9 serves also as a flow path wall member forming the walls of the flow paths 13. The sealing member 11 may be in close contact with the lateral surface of the flow path wall member. The flow path wall member is composed of a cured product of an epoxy resin, a metal, or silicon nitride.

The electric wiring member 1 is bonded and fixed to the supporting member 5, and may be partially in contact with the sealing member 11. The supporting member 5 is made of, for example, engineering plastic resin, alumina, ceramic, or metal.

Figure 4A:
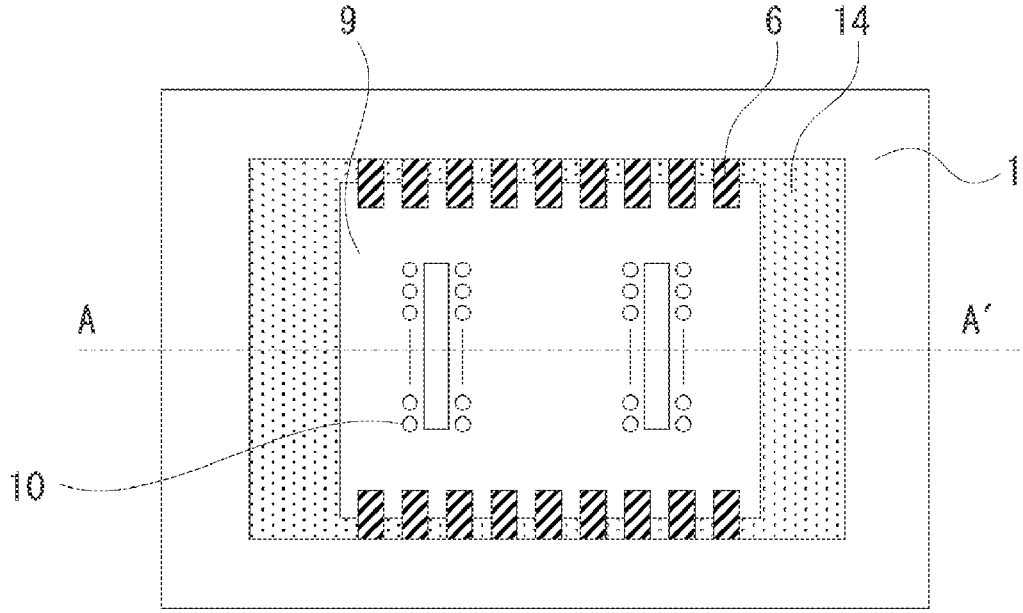
FIGS. 4A and 4B illustrates top and cross sectional views illustrating a manufacturing process of the liquid discharge head according to an exemplary embodiment of the present invention.
Figure 4B:
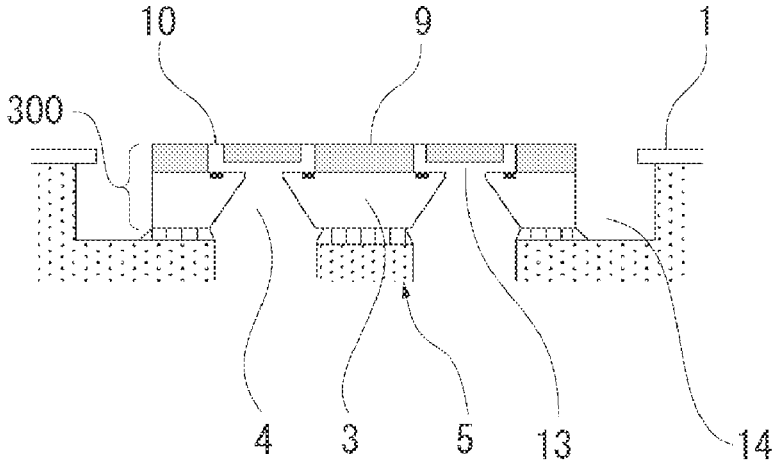

The material and the sealing process of the sealing member 11 according to an exemplary embodiment of the present invention are described below in detail. FIG. 4A is a top view illustrating the sealing part before the application of the sealing member. FIG. 4B is an A-A' cross sectional view of FIG.

4A. A composition to be the end face sealing member for protecting the sides of the substrate 3 from ink and dust is applied to sites 14 to be coated with the end face sealing member. The composition is further coated with a second composition (electrical contact sealant) to be the lead sealing member 12 for sealing the leads 6 as electrical contacts. The lead sealing member 12 extends from the substrate to the leads and support. Subsequently, the material to be the end face sealing member and the lead sealing member are cured. They may be thermally cured by heating them simultaneously. The time when curing stops can differ between them. After curing of one of them has been completed, the other may be further heated, thereby achieving sufficient degrees of cure for both of them. The end face sealing member is, for example, provided in the area where no lead sealing member is provided above, and may be not provided below the lead sealing member 12. In this case, the end face sealing member 11 is not provided, but the lead sealing member 12 is provided to fill the gap, thereby sealing the whole end faces of the substrate.

The substrate end face sealing member 11 and the lead sealing member 12 are described below.

The substrate end face sealing member 11 may quickly fill the sites 14 to be coated with the end face sealing member, which are located between the substrate and the plate 5 as the supporting member for the discharge element substrate. The sites 14 have a width of 1 mm or less, so that the substrate end face sealing member 11 may be fluid, and may protect the substrate from a liquid such as an ink and other factors.

The lead sealing member 12 may reliably seal the electrical parts. In addition, when the lead sealing member 12 is installed in a printer, it may not peeled off by rubbing with a blade or wiper for cleaning the surface having discharge ports, or by contact with paper caused by paper jam. Further, the lead sealing member 12 may be free from alkyl fluoride compound, low molecular weight cyclic siloxane, and other compounds which may inhibit the ink repellency function of the head face.

In order to perform the above function, the substrate end face sealing member 11 may be made of a flexible material with good flowability and low thixotropic nature in the wide environmental temperature range. On the other hand, the lead sealing member may be made of a shape-retaining material having high hardness, high viscosity, and high thixotropic nature.

The material of the end face sealing member according to an exemplary embodiment of the present invention is a composition having an epoxy resin including a butadiene skeleton as the main agent, and a curing agent having a butadiene skeleton. The butadiene skeleton refers to a structure containing a 1,4-butadiene or 1,2-butadiene structure, and does not specify the other portion of the structure. The butadiene skeleton may be referred to as a polybutadiene skeleton. The epoxy resin and the curing agent having a butadiene skeleton may be prepared by a method including oxidizing the double bond of butadiene, thereby achieving epoxidation, or a common method including introducing epoxy groups, carboxylic acid, amine, or amide into butadiene.

Examples of the epoxy resin having a butadiene skeleton include, but are not limited to, the structures expressed by formulae (1), (3), and (4):

(1)

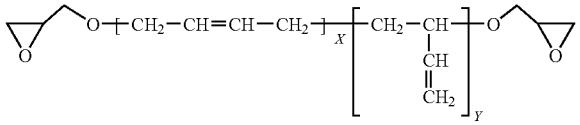

wherein X represents an integer from 1 to 100 inclusive, and Y represents an integer from 0 to 100 inclusive;

(3)

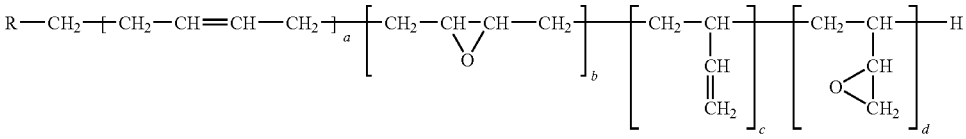

wherein R represents H or an alkyl group, a and b each represent an integer from 1 to 100 inclusive, and c and d each represent an integer from 0 to 100 inclusive;

(4)

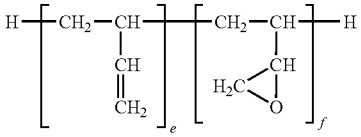

wherein e represents an integer from 24 to 35 inclusive, and f represents an integer from 8 to 11 inclusive.

Examples of the epoxy resin having a butadiene skeleton useful in the present invention include, but are not limited to, the following ones. Examples of commercially available ones include R657 (manufactured by Sartomer Company, Inc.), JP200 (manufactured by Nippon Soda Co., Ltd.), R45EPT (manufactured by Nagase ChemteX Corporation), BF1000 (manufactured by ADEKA Corporation), PB3600 (manufactured by Daicel Chemical Industries, Ltd.), and E-700-3.5 (manufactured by Nippon Petrochemicals Co., Ltd.).

Examples of the curing agent having a butadiene skeleton include, but are not limited to, the structures expressed by formulae (2), (5), and (6):

(2)

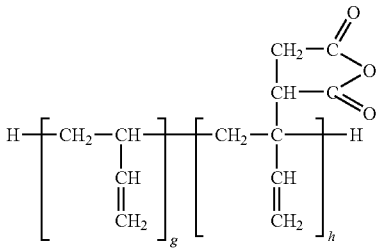

wherein g represents an integer from 10 to 30 inclusive, and h represents an integer from 1 to 4 inclusive;

(5)

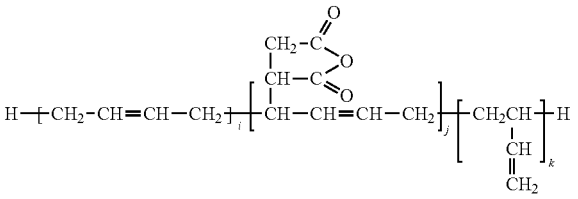

wherein i and j each represent an integer from 1 to 100 inclusive, and k represents an integer from 0 to 100 inclusive;

(6)

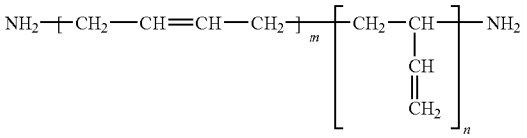

wherein m represents an integer from 1 to 100 inclusive, and n represents an integer from 0 to 100 inclusive.

Examples of the curing agent having a butadiene skeleton include, but are not limited to, BN-1015 (manufactured by Nippon Soda Co., Ltd.), R130MA8 (manufactured by Sartomer Company, Inc.), R130MA13 (manufactured by Sartomer Company, Inc.), and R131MA5 (manufactured by Sartomer Company, Inc.).

The resin having a butadiene skeleton may be hydrogenated. Hydrogen may be added in any stage; hydrogen may be added to the double bonds remaining after epoxy denaturation of polybutadiene, or partial hydrogenation of polybutadiene may be followed by epoxidation of the residual double bonds. When epoxy groups are introduced after end denaturation, hydrogen may be added in any stage before or after epoxy denaturation.

The epoxy resin, which is used as the main agent, and the curing agent are added in an amount such that the epoxy equivalent weight is equal to the acid anhydride or active hydrogen equivalent weight. When a curing accelerator is used, the loading of the curing agent may be decreased by about 10%, thereby producing a material having good ink resistance.

The viscosity may be adjusted using a diluent. The diluent may be a compound having a polysiloxane skeleton containing a group which can react with an epoxy resin. For example, a compound known as a reactive silicone oil may be used, the compound having a polysiloxane skeleton into which any organic group such as an epoxy group has been introduced. According to one aspect, those having two or more epoxy groups may be used, because they are highly reactive and thus enhance the hardness of the cured product. Examples of specific compounds include, but are not limited to, the structures expressed by formulae (7), (8), and (9):

(7)

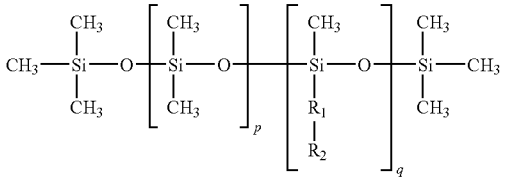

wherein p represents an integer from 1 to 1000 inclusive, and q represents an integer from 0 to 10 inclusive, $R_1$ represents an alkylene group, which may optionally contain an oxygen atom between carbon atoms, and $R_2$ represents a group selected from any one of an epoxy group, an amino group, a hydroxyl group, and a mercapto group;

(8)

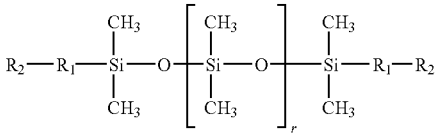

wherein r represents an integer from 1 to 100 inclusive, $R_1$ represents an alkylene group, which may optionally contain an oxygen atom between carbon atoms, and $R_2$ represents a group selected from any one of an epoxy group, an amino group, a hydroxyl group, and a mercapto group;

(9)

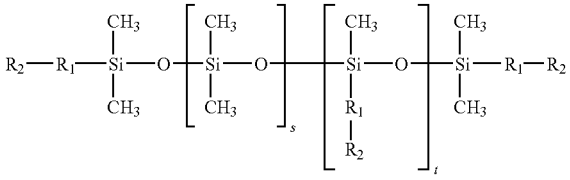

wherein s represents an integer from 1 to 500 inclusive, and t represents an integer from 1 to 10 inclusive, $R_1$ represents an alkylene group, which may optionally contain an oxygen atom between carbon atoms, and $R_2$ represents a group selected from any one of an epoxy group, an amino group, a hydroxyl group, and a mercapto group.

The epoxy group $R_2$ may be an alicyclic epoxy group. Examples of the reactive silicone oil include, but are not limited to, commercially available ones such as KF-101, KF-1001, X-22-343, X-22-2000, X-22-2046, KF-102, X-22-163, and KF-105 (manufactured by Shin-Etsu Chemical Co., Ltd.), and X-22-163A, X-22-163B, X-22-163C, X-22-169AS, X-22-169B, and X-22-9002 (manufactured by Shin-Etsu Chemical Co., Ltd.). The reactive silicone oil is added in an amount to achieve an intended viscosity. The ratio of the reactive silicone oil may be, but is not limited to, from 10 to 90 parts by weight with reference to 100 parts by weight of the epoxy resin having a butadiene skeleton. The diluent may be the reactive silicone oil, thereby achieving good compatibility and affinity with the epoxy resin having a butadiene skeleton and the curing agent having a butadiene skeleton. As a result of this, low viscosity may be achieved with the curability maintained and without the deterioration in the liquid resistance.

Examples of the curing catalyst used as a curing accelerator include, but are not limited to, imidazoles such as 2-methylimidazole, 2-phenyl imidazole, 1,2-dimethylimidazole, and 2-methyl-4-methylimidazole. Alternatively, imidazoles adducted to epoxy resins may be used as the curing catalyst, which can become solid, thus improving stability for preservation. Commercially available ones include Amicure PN-23 (manufactured by Ajinomoto Fine-Techno Co., Inc.). Examples of the curing catalyst further include tertiary amines such as tris(dimethylaminomethyl)phenol, benzyldimethylamine, and 1,8-diazabicyclo(5,4,0)undecene-7; cationic polymerization catalysts such as boron trifluoride amine complexes, and triphenyl sulfonium salts; and other catalysts such as triphenyl sulfone. Alternatively, a heat cationic polymerization initiator may be used. A photo cationic polymerization initiator may also optionally be used. Examples of the photo cationic polymerization initiator include aromatic onium salts.

The material of the substrate end face sealing member may contain a common epoxy resin and a curing agent for the purposes of the improvement of adhesiveness, decrease of viscosity, and adjustment of reactivity. Examples of the common epoxy resin include, but are not limited to, bis A type epoxy resins, phenol novolac epoxy resins, and other polyfunctional epoxy resins. Examples of the curing agent include, but are not limited to, acid anhydrides such as DDSA or MeHHPA, polyamines, and amides. Examples of other additives include, but are not limited to, epoxy monofunctionals, alcohols, phenols, silane coupling agents, oxetane, and vinyl ether. Fillers such as quartz may be added.

Since the main agent and the curing agent have a butadiene skeleton, the addition of a common age inhibitor may be effective at preventing oxidation deterioration, thus improving the long term reliability of the head. Examples of the age inhibitor include, but are not limited to, "NOCRAC TNP" and "NOCRAC NS-6" (trade name, manufactured by Ouchi Shinko Chemical Industrial Co., Ltd.).

According to a study by the inventors, an epoxy resin having a butadiene skeleton is poorly miscible with other general-purpose epoxy resin or a curing agent, and tends to be poorly cured by a common curing agent. The reason for this is likely that it has low polarity due to its skeleton, and has a lower SP value than general-purpose epoxy resins such as bisphenol A type epoxy resins.

According to aspects of the present invention, the curing agent has a butadiene skeleton, which is the skeleton of the main agent, and thus has good compatibility and affinity with the main agent, and improves the reactivity between them. Further, when provided between the substrate 3 and the supporting member 5, the substrate end face sealing member 11 according to aspects of the present invention is so flexible that it exerts little influences such as contraction stress on the substrate.

In consideration of the above-described properties, the main agent of the lead sealing member may or may not have a butadiene skeleton. The curing agent may be selected in consideration of compatibility with the main agent, and may or may not have a butadiene skeleton.

Examples of the present invention are illustrated below.

As the materials of the substrate end face sealing member, the compositions corresponding to Examples 1 to 6 and Comparative Examples 1 to 5 were prepared, and subjected to the following evaluations.

(Flexibility Evaluation)

Each of the compositions of Examples 1 to 6 and Comparative Examples 1 to 5 was placed on a Teflon (registered trademark) reaction plate in an amount of 2.5 g, and heated in an oven at 120° C. for one hour, thereby promoting curing, and then the elastic modulus of the cured product was measured using NANO INDENTER (manufactured by Fischer Instruments K.K.).

Evaluation Criteria

◎: Elastic modulus is 10 MPa or less.

○: Elastic modulus is 10 MPa or more and 500 MPa or less.

Δ: Elastic modulus is 500 MPa or more.

(Curability Evaluation)

Each of the compositions of Examples 1 to 6 and Comparative Examples 1 to 5 was placed on a Teflon (registered trademark) reaction plate in an amount of 2.5 g, and heated at 120° C. for one hour in an oven, thereby promoting curing, and then the cured product was touched with a finger for evaluating tackiness (surface tackiness).

Evaluation Criteria

○: not tacky

Δ: tacky (Co-Curability)

The sealant for the lead sealing member was applied to the sealant for the substrate end face sealing member, started to be heated, and subjected to the test corresponding to a manufacture method including co-curing.

The sealant having 2 g in amount for the lead sealing member was applied to 2 g of each of the compositions of Examples 1 to 6 and Comparative Examples 1 to 5, and heated in an oven at 150° C. for one hour, thereby promoting curing, and then the cured product was touched with a finger. The following sealants A and B were used as the sealants for the lead sealing member, and subjected to the evaluation of co-curability 1 and 2 corresponding to the lead sealing member sealants A and B.

| (Sealant A for lead sealing member) | |
|---|---|
| epoxy resin having butadiene skeleton (BF1000, manufactured by ADEKA Corporation) | 100 parts by weight |
| triethylenetetramine | 20 parts by weight |
| dimethylaminophenol | 1 part by weight |
| quartz filler (average particle size: 10 μm) | 350 parts by weight |
| silane coupling agent (A-187, manufactured by Nippon Unicar Company Limited) | 5 parts by weight |

| (Sealant B for lead sealing member) | |
|---|---|
| bis A type epoxy resin (EP-4100E, manufactured by ADEKA Corporation) | 100 parts by weight |
| hexahydrophthalic anhydride | 80 parts by weight |
| imidazole curing accelerator (2E4MZ, manufactured by Shikoku Chemicals Corporation) | 1 part by weight |
| quartz filler (average particle size: 10 μm) | 550 parts by weight |
| silane coupling agent (A-187, manufactured by Nippon Unicar Company Limited) | 5 parts by weight |

Evaluation Criteria

○: No separation is observed between the end face sealing member and lead sealing member.

Δ: Some separation is observed between the end face sealing member and lead sealing member.

(Mounting Evaluation)

The liquid discharge head illustrated in FIG. 2 was made by the following method. Firstly, a mold filling the portions to be the ink flow paths was provided on the substrate surface, and then the following resin composition for forming the flow path wall was applied thereon, and baked on a hot plate at 80°

C. for three minutes, thus forming a resin layer having a thickness of 80 μm. Subsequently, patterning was performed using MPA-1500 (manufactured by Canon Inc.), thus forming a flow path wall member which also serves as a discharge port member. Subsequently, a liquid supply port penetrating from the back surface to the front surface of the substrate was formed. Thereafter, the mold was removed, and the substrate was cut into a chip with a size necessary for a head, thus obtaining a liquid discharge head. The sealing resin compositions of Examples 1 to 6 and Comparative Examples 1 to 5 were individually applied to the boundary between the sides (cross sections) of the substrate and the flow path wall member on the chip, and heated in an oven at 150° C. for one hour, thereby curing the sealant around the substrate. Thereafter, the boundary was observed.

(Resin Composition for Forming Flow Path Walls)

epoxy resin (EHPE-3150, manufactured by Daicel Chemical Industries, Ltd.) 100 parts by weight photoacid generator (ADEKA OPTMER SP-170, manufactured by ADEKA Corporation) 2 parts by weight Diglyme 100 parts by weight (Evaluation Criteria)

○: No infiltration is observed at the interface between the substrate and flow path wall member.

Δ: Infiltration is observed at the interface between the substrate and flow path wall member.

The results of the evaluations are summarized in Table 1. Numbers in the table indicate parts by weight, and represent the weight ratios of the components.

TABLE 1

| | | Examples | | | | | | Comparative Examples | | | | |
|---|---|---|---|---|---|---|---|---|---|---|---|---|
| | Name | 1 | 2 | 3 | 4 | 5 | 6 | 1 | 2 | 3 | 4 | 5 |
| Sealant composition | Butadiene skeleton epoxy resin (*1) | 100 | 100 | 100 | | | 100 | 100 | | | | |
| | Butadiene skeleton epoxy resin (*2) | | | | 100 | 100 | | | 100 | 100 | 100 | |
| | Bisphenol A type epoxy resin (*3) | | | | | | | | | | | 100 |
| | Butadiene skeleton acid anhydride curing agent (*4) | 40 | 40 | 40 | | | 40 | | | | | |
| | Butadiene skeleton acid anhydride curing agent (*5) | | | | 350 | 350 | | | | | | |
| | Amine curing agent (*6) | | | | | | | | | | 20 | |
| | Acid anhydride curing agent (*7) | | | | | | | | | 70 | | 80 |
| | Imidazole catalyst (*8) | 1 | | 1 | 4 | | 1 | 4 | 4 | 1 | | 1 |
| | Imidazole catalyst (*9) | | 2.5 | | | | | | | | | |
| | Tertiary amine catalyst (*10) | | | | | | | | | | 1 | |
| | Cationic catalyst (*11) | | | | | 4 | | | | | | |
| | Epoxy reactive diluent (*12) | | | 15 | | | | | | | | |
| | Reactive silicone oil (*13) | | | | | | 50 | | | | | |
| Evaluation Item | Flexibility | ◎ | ◎ | ◎ | ◎ | ◎ | ◎ | ○ | ○ | Δ | ○ | Δ |
| | Curability | ◎ | ○ | ◎ | ◎ | ◎ | ◎ | Δ | Δ | ○ | Δ | ○ |
| | Co-curability (1) | ○ | ○ | ○ | ○ | ○ | ○ | Δ | ○ | ○ | ○ | Δ |

TABLE 1-continued

| Name | Examples 1 | 2 | 3 | 4 | 5 | 6 | Comparative Examples 1 | 2 | 3 | 4 | 5 |
|---|---|---|---|---|---|---|---|---|---|---|---|
| Co-curability (2) | ○ | ○ | ○ | ○ | ○ | ○ | Δ | Δ | Δ | Δ | ○ |
| Mounting evaluation | ○ | ○ | ○ | ○ | ○ | ○ | ○ | ○ | Δ | Δ | Δ |
| Viscosity | ○ | ○ | ○ | ○ | ○ | ◎ | ○ | ○ | ○ | ○ | ○ |

(*1): R45EPT (trade name), manufactured by Nagase ChemteX Corporation
(*2): BF1000 (trade name), manufactured by ADEKA Corporation
(*3): EP-4100E (trade name), manufactured by ADEKA Corporation
(*4): BN-1015 (trade name), manufactured by Nippon Soda Co., Ltd.
(*5): R130MA13 (trade name), manufactured by Nippon Soda Co., Ltd.
(*6): triethylenetetramine
(*7): hexahydrophthalic anhydride
(*8): 2E4MZ (trade name), manufactured by Shikoku Chemicals Corporation
(*9): TEP-2E4MZ (trade name), manufactured by Nippon Soda Co., Ltd.
(*10): dimethylaminophenol
(*11): ANCHOR 1140 (trade name), Air Product Japan, Inc.
(*12): ED-518S (trade name), manufactured by ADEKA Corporation
(*13): KF-105(trade name), manufactured by Shin-Etsu Chemical Co., Ltd.); KF-105 has two or more epoxy groups.

The results of the flexibility evaluation and curability evaluation illustrated in Table 1 indicate that Examples 1 to 6 achieved both flexibility and high reactivity, but Comparative Examples 1 to 5 did not achieve this. For example, the comparison between Examples 1 to 3 and Comparative Example 1 indicates that Examples achieved sufficient flexibility and curability in comparison with Comparative Examples. The reason for this is likely that the combination of an epoxy resin having a butadiene skeleton as the main agent and an acid anhydride having a butadiene skeleton as the curing agent achieved high affinity between them, and thus the curing reaction successfully proceeded, and higher flexibility was achieved. This is also understood by the comparison between Examples 4, 5 and Comparative Examples 2 to 4.

The inventors have found that the use of an epoxy resin as the main agent and a curing agent each having a butadiene skeleton markedly improves the reactivity between them. The improvement in the reactivity is proved by the comparison of the compatibility between an epoxy resin and a curing agent each having a butadiene skeleton and the compatibility between an epoxy resin and a curing agent each having no butadiene skeleton. When the SP value is calculated by Small's estimation method, the epoxy resin and curing agent each having no butadiene skeleton have an SP value of about 20 $(J/cm^3)^{1/2}$. On the other hand, the epoxy resin and curing agent each having a butadiene skeleton have an SP value of about 16 $(J/cm^3)^{1/2}$. It is thus considered that there is poor compatibility between the epoxy resin having a butadiene skeleton and the curing agent having no butadiene skeleton, which are used in Comparative Examples.

Comparative Examples 1, 2, and 4 included the combinations of epoxy resins having a butadiene skeleton and curing agents having no butadiene skeleton. Therefore, the compatibility was poor, reactivity was low, and thus the crosslinking density poorly increased. This is likely the reason for the insufficient curing at the low temperature.

As indicated by the result of the co-curability evaluation, no uncured portion was detected in the Examples, irrespective of whether the sealant A or B was used as the lead sealing member sealant. The reason for this is likely that the compatible between the epoxy resin as the main agent and the curing agent was so good that curing proceeded at a sufficient rate, hence there was little difference in the curing rate between the substrate end face sealing member and the lead sealing member, so that the substrate end face sealing member was deprived of its curing agent by the lead sealing member.

In the evaluation of the liquid discharge head in a mounted form for the Examples, no infiltration of the substrate end face sealing member was detected at the interface between the substrate and flow path wall member. As described above, the SP values of the epoxy resin and curing agent each having a butadiene skeleton are far different from those of common epoxy resins, so that they show low affinity with the epoxy resin used in the flow path wall member. This is likely the reason for no infiltration of the sealant at the interface between the substrate and the flow path wall member. The bonding between the flow path wall member and substrate was kept in a good condition, which will contribute to the long-term reliability of the liquid discharge head.

As shown by Example 6, the viscosity was effectively decreased through the use of the reactive silicone oil having an SP value close to those of the epoxy resin and curing agent each having a butadiene skeleton. As a result of this, application of the substrate end face sealing member was completed in a short time.

The Examples thus show that aspects of the present invention may provide a liquid discharge head including a substrate whose sides are sealed with a sealing member having good liquid resistance and high reliability, and a method for manufacturing the liquid discharge head in a short time.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2009-143525 filed Jun. 16, 2009 and No. 2009-230649 filed Oct. 2, 2009, which are hereby incorporated by reference herein in their entireties.

What is claimed is:

1. A liquid discharge head comprising:

a substrate having, on one side thereof, energy generating elements for generating energy used for discharging liquid; and a sealing member arranged in contact with at least a part of one or more end faces of the substrate, the sealing member being a cured product of a composition comprising an epoxy resin expressed by at least any one of formula (1), (3) and (4) and an epoxy resin curing agent expressed by at least any one of (2), (5) and (6)

(1)

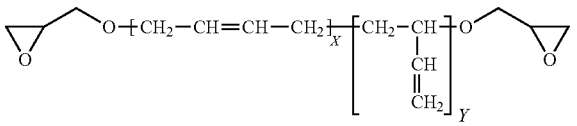

wherein X represents an integer from 1 to 100 inclusive, and Y represents an integer from 0 to 100 inclusive;

(3)

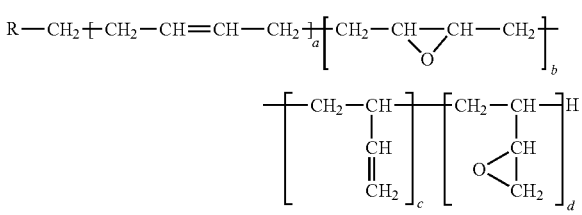

wherein R represents H or an alkyl group, a and b each represent an integer from 1 to 100 inclusive, and c and d each represent an integer from 0 to 100 inclusive;

(4)

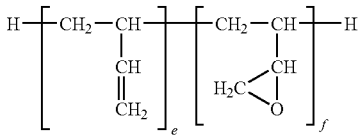

wherein e represents an integer from 24 to 35 inclusive, and f represents an integer from 8 to 11 inclusive;

(2)

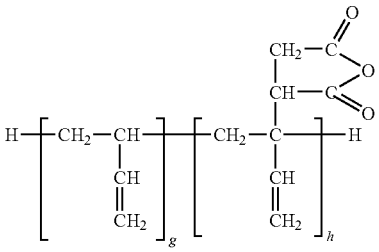

wherein g represents an integer from 10 to 30 inclusive, and h represents an integer from 1 to 4 inclusive;

(5)

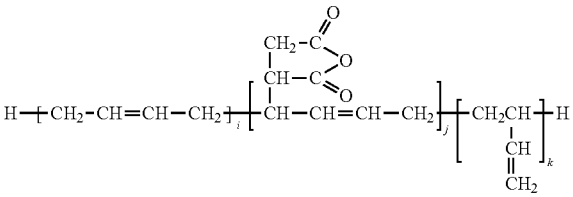

wherein i and j each represent an integer from 1 to 100 inclusive, and k represents an integer from 0 to 100 inclusive;

(6)

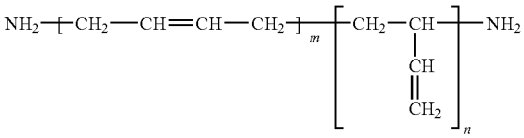

wherein m represents an integer from 1 to 100 inclusive, and n represents an integer from 0 to 100 inclusive.

2. The liquid discharge head according to claim 1, wherein the sealing member is arranged all around the end faces of the substrate.

3. The liquid discharge head according to claim 1, wherein the substrate is supported by a supporting member.

4. The liquid discharge head according to claim 1, wherein the substrate has thereon a flow path wall member having walls of flow paths communicating with liquid discharge ports provided corresponding to the energy generating elements, the sealing member being in contact with at least a part of one or more end faces of the flow path wall member.

5. The liquid discharge head according to claim 1, wherein the composition includes a compound containing a group that can react with the epoxy resin and having a polysiloxane skeleton.

6. The liquid discharge head according to claim 5, wherein the compound having the polysiloxane skeleton is expressed by formula (8):

(8)

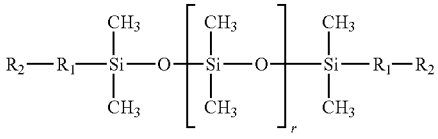

wherein r represents an integer from 1 to 100 inclusive, $R_1$ represents an alkylene group, optionally having an oxygen atom between carbon atoms, and $R_2$ represents a group selected from any one of an epoxy group, an amino group, a hydroxyl group, and a mercapto group.

* * * * *